United States Patent [19]

Jeschke et al.

[11] 4,171,130

[45] Oct. 16, 1979

[54] CONTROL OF WITHDRAWAL OF FLAT ITEMS INDIVIDUALLY FROM A STACK

[75] Inventors: Henning Jeschke, Constance; Winfried Bruchmann, Reinheim, both of Fed. Rep. of Germany

[73] Assignee: Licentia Patent-Verwaltungs-G.m.b.H., Frankfurt, Fed. Rep. of Germany

[21] Appl. No.: 883,849

[22] Filed: Mar. 6, 1978

[30] Foreign Application Priority Data

Dec. 24, 1977 [DE] Fed. Rep. of Germany ..... 2758007

[51] Int. Cl.[2] ..... B65H 3/02; B65H 7/02

[52] U.S. Cl. ..... 271/10; 271/111; 271/259

[58] Field of Search ..... 271/110, 111, 259, 265, 271/114, 34, 35, 10, 11, 12, 13, 14, 15, 16, 17

[56] References Cited

U.S. PATENT DOCUMENTS

| | | | |
|---|---|---|---|
| 3,981,493 | 9/1976 | Klappenecker et al. | 271/10 |
| 4,077,620 | 3/1978 | Frank et al. | 271/10 |
| 4,082,263 | 4/1978 | Baumberger et al. | 271/265 |

*Primary Examiner*—Bruce H. Stoner, Jr.
*Attorney, Agent, or Firm*—Spencer & Kaye

[57] ABSTRACT

During the successive discharge and conveyance, along a conveying path, of items of mail from a stack by a continuously driven conveying device and an externally controllable removal member arranged to transport successive items from the stack to the region of action of the conveying device, the desired spacing between each pair of successive items is established automatically as a function of the length of that item of such pair which is the leading item on the conveying path such that for a leading item whose length exceeds a predetermined length value, the next succeeding item is transported from the stack when the distance between the trailing edge of that leading item and the leading edge of the next succeeding item reaches a given first spacing value, and for a leading item whose length is less than the predetermined length value, the next succeeding item is transported from the stack when the distance between the leading edge of that leading item and the leading edge of the next succeeding item reaches a given second spacing value.

10 Claims, 5 Drawing Figures

232
232.1 .2 .3 .4 .5 .6 .7
233
233.1 .2 .3 .4 .5 .6 .7
236

130
133
133.1 .2 .3 .4 .5 .6 .7
136
132
132.1 .2 .3 .4 .5 .6 .7
134
135
93
93'
93''
73

CONTROL OF WITHDRAWAL OF FLAT ITEMS INDIVIDUALLY FROM A STACK

BACKGROUND OF THE INVENTION

The present invention relates to a method for use in an apparatus for the successive discharge of individual objects of different lengths, such as items of mail for example, to control the withdrawal of each object from a stack of such objects on a conveying path in dependence on the changing position of a reference edge, which can be the leading or trailing edge, of the previously discharged object.

Prior art methods and apparatus for controlling the withdrawing procedure in such devices are disclosed in German Offenlegungsschrift [Laid-Open Patent Application] No. 24 10 145, and its counterpart U.S. Pat. No. 3,981,493, Klappenecker et al, which discloses a withdrawal device having the above-mentioned features and cooperating with a pair of continuously driven conveying rollers arranged downstream of the stack and forming the inlet for a further conveying path. This arrangement is combined with: a controllable withdrawal device which cooperates with each object to be separated from the stack and which advances that object to the effective range of the conveying rollers upon receipt of a control signal; a monitoring device which emits signals in dependence on the passage of a reference edge, i.e. the leading or trailing edge, of an object that has entered the conveying path; and a control circuit which emits a control signal, in dependence on the signals from the monitoring device, to the withdrawal device whenever the distance of the reference edge of the item being processed from the leading edge of the next object in the effective range of the withdrawal device has exceeded a given value.

In this known apparatus, the monitoring device is designed, as shown in FIG. 8 of U.S. Pat. No. 3,981,493, to emit an output signal whenever the distance between the leading edge of the object which has entered the conveying path and the leading edge of the next object which is still in the effective range of the withdrawal device has exceeded a given value B. The objects are thus discharged into the conveying path in such a way that the distances from leading edge to leading edge are identical. When separating objects having different lengths, the value for distance B must be selected so that sufficient space remains between an object with the longest length which the apparatus can handle and the next object.

Let it be assumed, for example, that during automatic processing of mail the length of the objects fluctuates between 135 mm and 240 mm and that, to assure dependable operation of the switches in a subsequent distributing machine, the gaps, or spaces, between the objects must be not less than 90 mm. To enable such gaps to be produced even with long objects, the distance B from leading edge to leading edge must therefore be given the value $240+90=330$ mm, which, in order to allow for some degree of slip that might occur on a later conveying path, must be increased to 350 mm. Therefore, behind a short object, a gap of $350-135=215$ mm occurs, instead of the minimum required value of 90 mm. One result is less than optimum utilization of the capacity of the subsequent sections of the system in which the objects are being conveyed.

It thus follows that it is desirable for the monitoring device to discharge the succession of objects from the stack and the control circuit so that the gaps between consecutive objects have identical lengths. The monitoring device emits an output signal when the distance of the trailing edge of the object entering the conveying path from the leading edge of the next object which is still in the effective range of the withdrawal device has exceeded a given value A. Such a device is shown, for example, in FIG. 7 of U.S. Pat. No. 3,981,493, cited above.

Theoretically, the control of the separation to produce uniform gaps should result in the highest possible conveying density. In practice, however, there is a further point which must be considered, i.e. the requirement that the above-mentioned distance from the leading edge of one object to the leading edge of the next succeeding object must not be arbitrary. Rather, in view of the mutual spacing of the light barriers disposed along the conveying path of a subsequent distributing machine and associated with an accompanying memory for the switch control, they must not fall below a certain value of, for example, 280 mm. If the control process produces gaps of identical length equal to 90 mm, the above-mentioned object length range results in leading edge distances of $135+90=225$ mm to $240+90=330$ mm. That means that the distance from leading edge to leading edge appearing after a short object would be too small. Therefore, to take full account of the limitations imposed by short objects, the separation process must thus be controlled in practice, for example, to produce a gap of $A=280-135=145$ mm for the shortest objects.

However, even this does not fully utilize the highest theoretically possible conveying output. Since nevertheless this process still produces a better utilization of the conveying output than that which produces a uniform distance B between successive leading edges, the art has been willing to be satisfied with the conveying density that can be obtained under control of the separation process which produces a uniform gap A. Separating devices used in combination with automatic mail distributing systems are presently generally controlled according to the last mentioned of the two above discussed methods.

SUMMARY OF THE INVENTION

It is an object of the present invention to control the withdrawal process in a device of the above-mentioned type which, under consideration of the smallest permissible value for the distance from leading edge to leading edge and with better utilization of the smallest permissible value for the gap between successive items, results in improved conveying density.

This is accomplished according to the present invention in a procedure for discharging items whose lengths vary over a given range in succession from a stack and conveying the items, after discharge, along a conveying path with each item being oriented such that its length is parallel to the direction of conveyance and with each item on the conveying path being spaced from the next succeeding item subsequently discharged from the stack, by automatically controlling the discharge of each item in dependence on the length of the respective immediately preceding item on the conveying path in a manner such that for an immediately preceding item having a length exceeding a predetermined length value, the next succeeding item is introduced into the conveying path with its leading edge a first predetermined distance behind the trailing edge of such immediately preceding item, and for an immediately preceding item having a length less than the predetermined length value, the next succeeding item is introduced into the conveying path with its leading edge a second predetermined distance behind the leading edge of such immediately preceding item.

The invention further provides an apparatus which permits the practice of this method in a particularly advantageous manner. Starting from the state of the art disclosed in U.S. Pat. No. 3,981,493, this apparatus includes a pair of continuously driven conveying rollers which are arranged downstream of the stack outlet and form the entrance of the conveying path, a controllable withdrawal device disposed between the conveying path and the stack and arranged to discharge each item in succession from the stack cooperating with the respective item to be separated and operative in response to a control signal to advance each such item into the effective range of the conveying rollers, a monitoring device arranged to emit signals in dependence on the passage of the leading or trailing edge of an item past a point along the conveying path, and a control circuit arranged to produce the control signal for the withdrawal device in dependence on the signals from the monitoring device when the distance of the leading or trailing edge of the respective item from the leading edge of the next succeeding item present in the effective range of the withdrawal device has exceeded a given value. According to the present invention, the monitoring device includes means for emitting a first output signal when the distance of the trailing edge of the item on the conveying path from the leading edge of the next succeeding item present in the effective range of the withdrawal device has exceeded a first predetermined distance, and means for emitting a second output signal when the distance of the leading edge of the item on the conveying path from the leading edge of the next succeeding item present in the effective range of the withdrawal device has exceeded a second predetermined distance, these means for emitting being arranged such that the difference between the first and second distances is greater than the length of an item whose length is in the lower portion of the given range of lengths and less than the length of an item whose length is in the upper portion of the given range of lengths, and the control circuit includes means for emitting a control signal for advancing the next succeeding object as soon as both the first and second output signals are emitted by the monitoring device.

DESCRIPTION OF THE PREFERRED EMBODIMENTS

Figure 1:
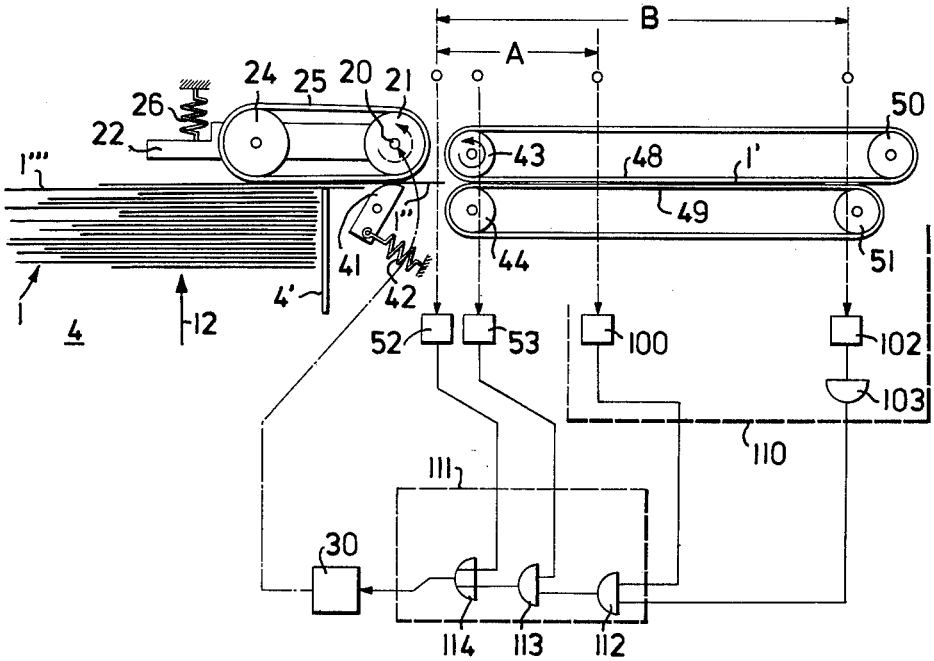
FIG. 1 is a pictorial top plan view of the basic components of a first embodiment of a separating device for mail according to the invention provided with a monitoring device including two light barriers.

The apparatus shown in FIG. 1 includes a known separator device illustrated in simplified form at the left half of FIG. 1, one form of which is disclosed in detail in the above-mentioned U.S. Pat. No. 3,981,493, and is thus known in the art. To aid comparison, the reference numerals employed in FIG. 1 are the same as those used for corresponding elements as do FIGS. 1, 2, 7 and 8 of the drawings of U.S. Pat. No. 3,981,493.

A stack of upright, i.e. on-edge, items of mail 1 of different lengths is disposed on a supporting surface 4. A supporting member (not shown) acts against the rear end of the stack in the direction of the arrow 12 and a known follow-up control automatically maintains the contact pressure required for the separation process.

On a freely rotatable shaft 20 there is fastened a roller 21. The shaft 20 also serves as a pivot mount for rocker 22 on which a further roller, i.e. a withdrawal roller, 24 is mounted. A withdrawal belt 25 whose outer surface has a high coefficient of friction is wound around rollers 21 and 24 and serves as the separating member. The rocker 22 is supported relative to the machine frame by a compression spring 26 so that its position at any given time depends on the momentary contact pressure of the stack. The free end of rocker 22 acts in a known manner on a micro-switch (not shown) which is part of the above-mentioned follow-up control.

Shaft 20 is driven in the direction of the broken line arrow by a motor (not shown) which runs continuously during operation of the system. The drive to shaft 20 is controllable by means of a brake coupling 30 which thus permits the shaft to be driven intermittently. The brake coupling is designed in a known manner to connect the shaft 20 to the drive when a control signal is present at the output of a control circuit 111 and to brake the shaft by opening of this connection when such control signal is absent.

The edges, e.g. leading edges, of the items 1 in the stack, which edges point in the transporting direction, more or less firmly contact an abutment wall 4' which forms a gap with the withdrawal belt 25 to permit passage of the objects. That gap constitutes the stack output. Opposite roller 21, a stripper 41 which is pivotal about a stationary axis is disposed in the conveying path. The stripper is pressed by a tension spring 42 against the withdrawal belt 25 in the region where the latter is guided about roller 21 or against the objects 1" carried along thereby, respectively.

A pair of continuously driven conveying rollers 43 and 44 is provided in the conveying path of the objects so as to transport the objects in a positive manner as soon as they have reached the effective range of those rollers. These conveying rollers serve additionally as guide rollers for conveyor belts 48 and 49 which are wound around further downstream guide rollers 50 and 51. While the driven conveying roller 43 is mounted on the base plate of the machine, conveying roller 44 can be resiliently mounted in a known manner, for example on a pivotal lever, which is, however, not shown in the drawing for the sake of simplicity.

A light barrier 52 is provided between stripper 41 and conveying rollers 43 and 44 to sense the presence of an object. A further light barrier 53 is disposed in the effective range of conveying rollers 43 and 44. The light barriers emit an output signal representing a logic one ("1") when no object 1 obturates them and emit no output signal representing a logic zero ("0") if an object is present.

At a distance A from light barrier 52 a light barrier 100 is provided in the range of the continuing conveying path 48/49 and a further light barrier 102 is disposed at a distance B from the light barrier 52, the output signal from this further light barrier 102 being conducted through an inverter 103.

Distances A and B are selected so that their difference B−A is greater than the length of a short object and less than the length of a long object. Elements 100, 102 and 103 together form a monitoring device 110.

The illustrated control circuit 111 of the separating device includes, in simplified representation, only the elements of significance with respect to the given conditions, i.e.: an AND circuit 112 having respective inputs which receive the output signals from light barrier 100 and inverter 103; an AND circuit 113 whose inputs are connected with the outputs of the AND circuit 112 and of the light barrier 53; and an OR circuit 114 whose inputs are connected with the outputs of the AND circuit 113 and of the light barrier 52 and whose output signal serves to control the brake coupling 30 of the withdrawal device.

The apparatus shown in FIG. 1 operates in the following manner:

Let it be assumed that the situation is as shown in FIG. 1 where a short object 1' is being carried along to the right on the conveying path 48/49 and the next object 1'' is still disposed in the effective range of the withdrawal belt 25 so that its leading edge obturates the light barrier 52. The latter therefore does not emit an output signal.

The monitoring device 110 including the light barriers 100 and 102/103 emits an output signal from light barrier 100, since that barrier is not covered by an object, to AND circuit 112 of the control circuit 111, but not an output signal from barrier 102, which is likewise unobstructed, since the signal is converted to a logic zero by the inverter 103. Thus a zero is also present at the outputs of the AND circuit 113 and of OR circuit 114, i.e. the control circuit 111 does not emit a control signal for the brake coupling 30 of the withdrawal belt 25 so that the belt is halted.

However, as soon as the leading edge of the object 1' intersects the light barrier 102, both the light barrier 100 and the inverter 103 of the monitoring device 110 emit a "1" output signal and a "1" is present at the output of the AND circuit 112. Since the light barrier 53 is also then emitting a "1" the AND circuit 113 emits a "1" signal which is transmitted via OR circuit 114 to coupling 30 as a control signal which starts the drive for the withdrawal belt 25. This advances the next item 1'' into the effective range of conveying rollers 43 and 44. It is advisable, and a prerequisite in the illustrated embodiment, for the withdrawal belt 25 to rotate at essentially the same speed as conveyor belts 48 and 49.

As soon as the object 1'' which has advanced into the effective range of belts 48 and 49 intersects the light barrier 53, the AND circuit 113 can no longer emit a signal and thus control circuit 111 can no longer emit a control signal so that the withdrawal belt 25 is stopped again. Notwithstanding this, conveying rollers 43 and 44 continue to pull object 1'' further out of the range of withdrawal belt 25 and stripper 41 so that object 1'' follows object 1' with a distance B being maintained between their leading edges.

If during withdrawal of the object 1'' a further object 1''' were pulled out of the stack as a result of the friction force between these objects, object 1''' would be held back by stripper 41. As soon as the trailing edge of item 1'' passes light barrier 52, so that the light barrier is uncovered, a control signal for actuating the withdrawal device is again produced via OR circuit 114. Then, the above-mentioned further object 1''' is pulled from the range of the stripper 41, or out of the stack, respectively, and is advanced its leading edge obturates the light barrier 52. The thus achieved operating position again corresponds to the starting position shown in FIG. 1 in which an object is disposed in the range of the monitoring device 110 and the next object is in a "waiting position" at the light barrier 52.

Whikle object 1' was shorter than the difference B−A between the distance values A and B, the next object 1'' is a long object whose length is greater than the difference B−A. Upon passage of the object 1'' through the effective range of the monitoring device 110, its leading edge covers the light barrier 102 before its trailing edge clears light barrier 100. Therefore, initially a logic "1" signal is emitted to the control circuit 111 by inverter 103 while a logic "0" is being supplied by light barrier 100. This constitutes the "second output signal". Only after the trailing edge of the object 1'' has passed beyond light barrier 100 will it emit a "1" signal to the control circuit 11, this condition constituting the "first output signal". From this moment on, the control circuit 111 emits a control signal so that the object 1''' is advanced into the effective range of conveying rollers 43 and 44 with the distance between its leading edge and the trailing edge of object 1'' being equal to distance A.

It is thus evident that in the apparatus according to the invention there occurs an automatic selection of that reference edge of an object, in dependence on its length, which is to be decisive for the control of the withdrawal process for the next object. As a result, for short objects the leading edge is selected to be the decisive one and for long objects the trailing edge.

The above-described distance values A and B may be set so that under existing operating conditions of the respective separating device there is achieved an optimum conveying density. The operating conditions in the given circumstances include the smallest permissible distance of consecutive objects from leading edge to leading edge, the smallest possible gap from trailing edge to leading edge and the length distribution of the objects to be processed. In the embodiment of FIG. 1 these distance values are determined by the corresponding locations of light barriers 100 and 102 along the conveying path.

It is understood that the above-described distribution of components between monitoring device 110 and control circuit 111 is intended only to facilitate understanding but is not significant for the invention. It would equally be possible, for example, to associate the AND circuit 112 with the monitoring device 110 and then to state that the monitoring device emits a calling signal to the control circuit when the light barrier 100 is unobstructed and light barrier 102 is obstructed simultaneously.

Figure 2:
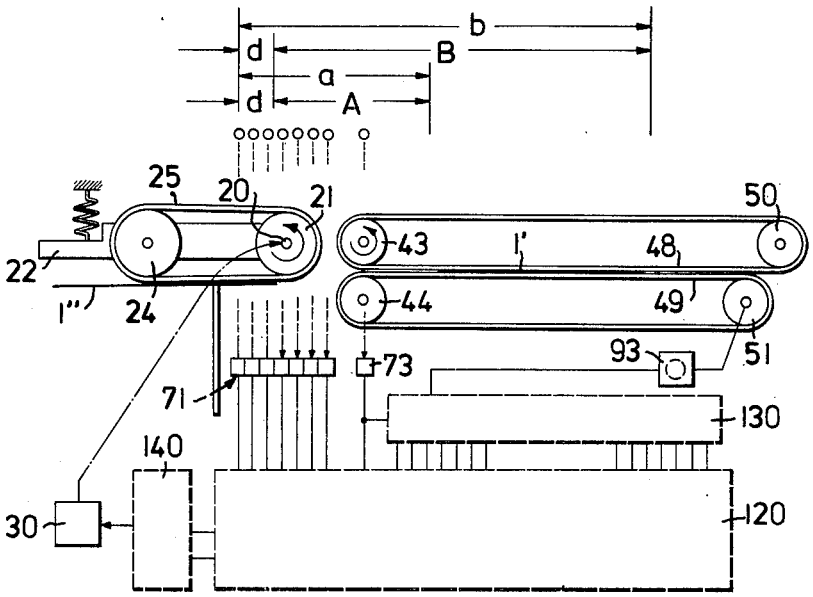
FIG. 2 is a view similar to that of FIG. 1 of a second embodiment of a separator device according to the invention for mail in which the monitoring device includes two effective measuring paths.
Figures 3, 5:
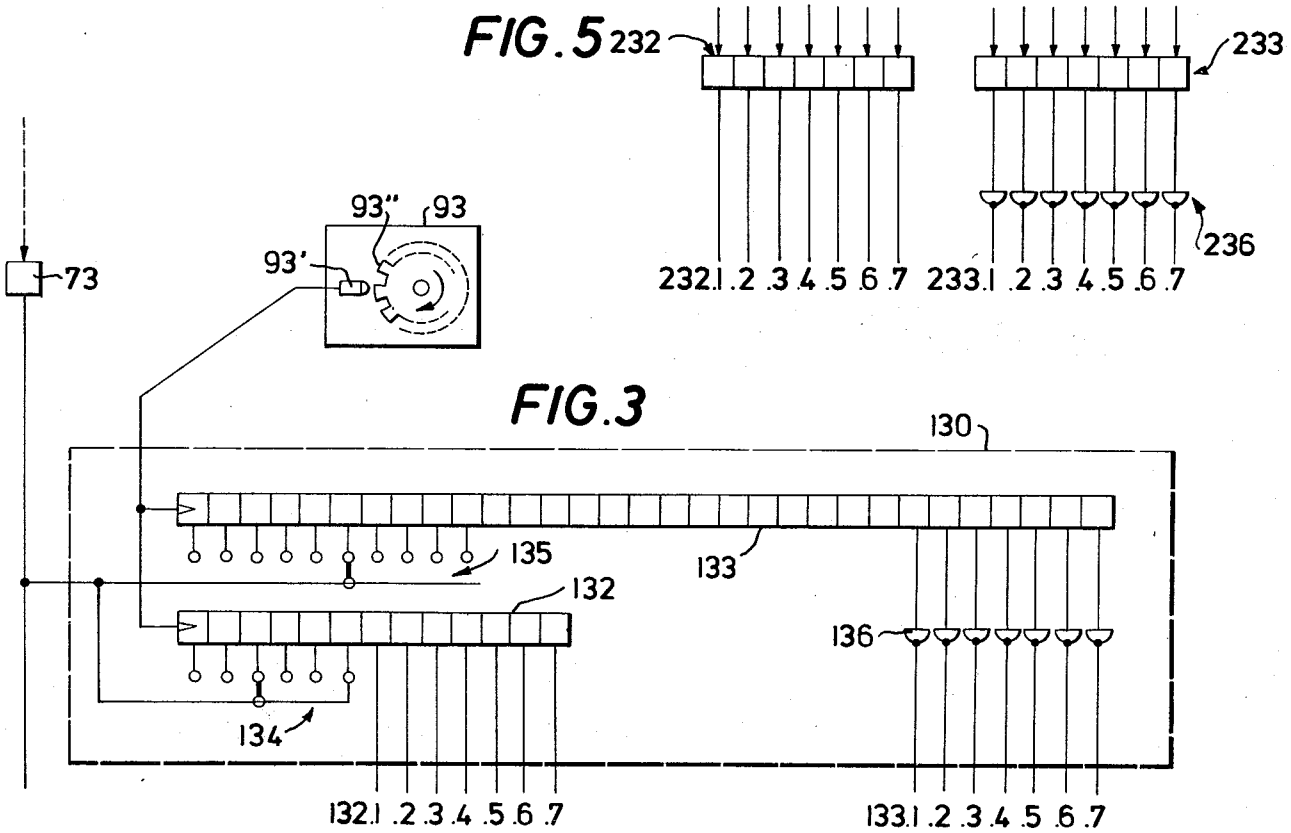
FIG. 3 is a schematic representation of one embodiment of the components defining the measuring paths of the monitoring device of the embodiment of FIG. 2.
FIG. 5 is a block circuit diagram of a second embodiment of a monitoring circuit which can be employed in systems according to the invention.
Figure 4:
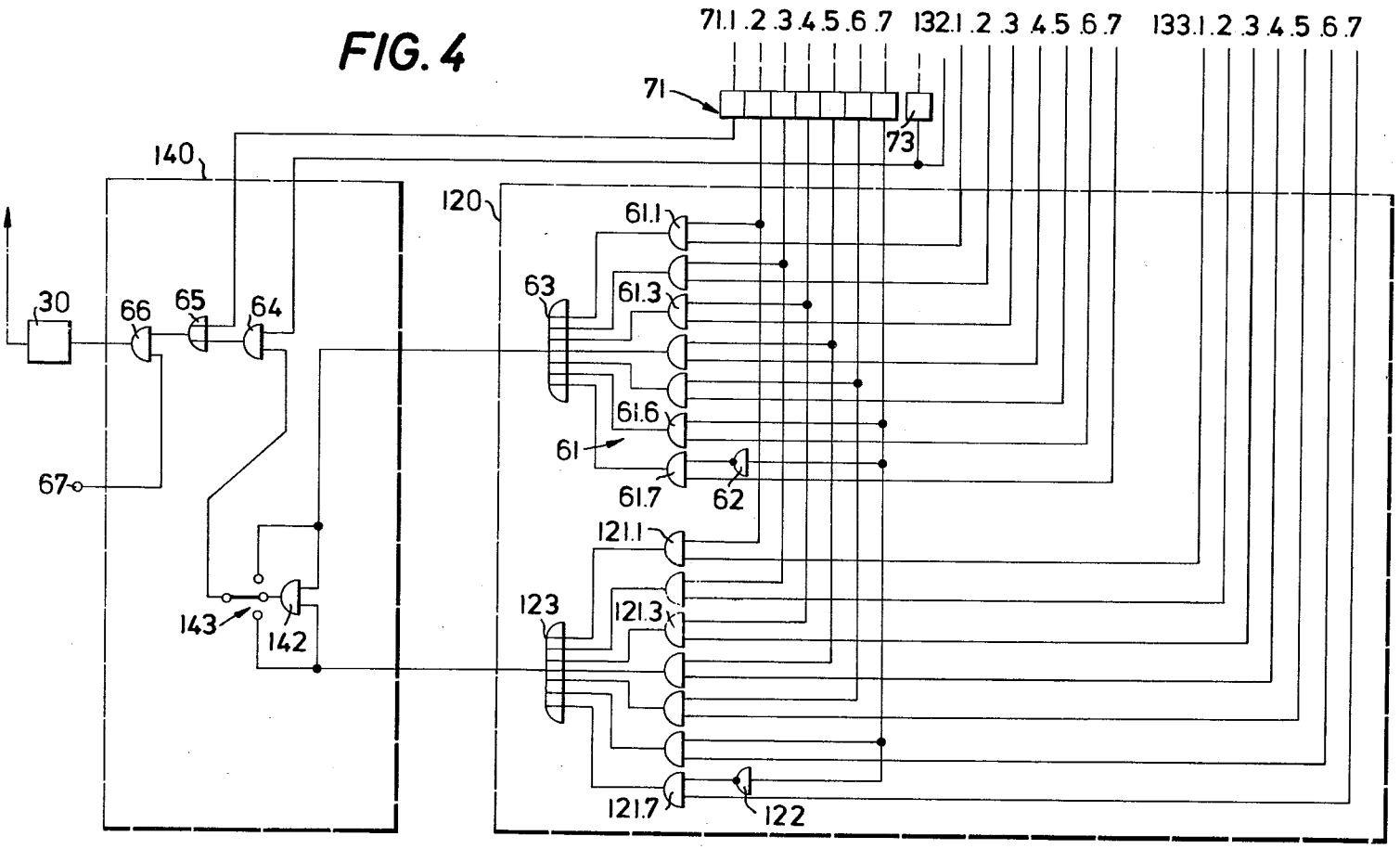
FIG. 4 is a circuit diagram of one preferred embodiment of components defining the linkage circuit and the control circuit of the embodiment of FIG. 2.

The embodiment shown in FIGS. 2 to 4 is based on a separator device which was first disclosed in German Offenlegungsschrift No. 26 13 261 and its counterpart, allowed U.S. patent application Ser. No. 781,467, filed by Frank et al on Mar. 25, 1977 now U.S. Pat. No. 4,077,620. The mechanical structure of the separator and of the conveying path downstream of the separator corresponds substantially to that of FIG. 1. In FIG. 2 the retaining device, corresponding to stripper 41, and the stack of objects 1 are not shown to simplify illustration.

Instead of the light barrier 52 which establishes a defined "waiting position", the apparatus according to FIG. 2 has a first measuring path 71 disposed between the output of the stack and the effective range of conveying rollers 43 and 44, which measuring path is designed so that its output signals are a measure for the portion of the path which has been traversed by the leading edge of an object 1" to be discharged, i.e. the distance d between the leading edge of that object and the beginning of measuring path 71.

In this embodiment, the measuring path 71 is formed by seven successive light barriers whose respective light receivers bear the reference numerals 71.1, 71.2, 71.3, 71.4, 71.5, 71.6 and 71.7 in FIG. 4. A further light barrier 73 which corresponds to light barrier 53 of FIG. 1, is disposed in the effective range of conveying rollers 43 and 44.

The monitoring device of this embodiment includes, in place of the light barriers 100 and 102, components defining second and third measuring paths. The third path is located downstream of the second path and these two paths have the characteristic features that the signal from the second measuring path is a measure for the distance a between the trailing edge of the object 1' within the range of the monitoring device and the beginning of the first measuring path 71 and that the signal from the third measuring path is a measure for the distance b between the leading edge of that object 1' and the beginning of the first measuring path 71.

The monitoring device is designed so that it emits a first output signal by logically linking the signals from the first, second and third measuring paths in a linkage circuit 120 when the difference a−d has exceeded the first distance value A and emits a second output signal when the difference b−d has exceeded the second distance value B. The manner in which this can be done will be explained below with reference to an example.

The second and third measuring paths which are part of the monitoring device, could be designed in the same manner as the first measuring path 71, as in the case of the device illustrated in FIG. 2 of German Auslegeschrift No. 26 13 261 and of allowed U.S. application Ser. No. 781,467, i.e. each path could be formed of a plurality of successive light barriers.

In the embodiment shown in FIG. 2, the second and the third measuring paths are constituted by a simulator 130 which simulates, in dependence on the output signal from a light barrier disposed before the start of the second measuring path and on the conveying speed effected by belts 48 and 49, the movement of an object entering the measuring paths. The last mentioned light barrier can be specially provided for this purpose or can be constituted by light barrier 73 which is provided already for other reasons. A pulse generator 93 serves to provide an indication of the conveying speed. This embodiment of the measuring path corresponds to that shown in FIGS. 6 and 7 of allowed U.S. application Ser. No. 781,467.

The pulse generator 93 is driven in unison with the continuously driven conveying rollers 43 and 44 so that it emits a sequence of pulses whose frequency corresponds to the conveying speed of the conveyor belts 48 and 49 wound around these conveying rollers and thus to the conveying speed in the second and third measuring paths. It may include, for example as shown in FIG. 3, a toothed disc 93" whose teeth are scanned by a suitable sensor 93' and which is driven by guide roller 51 of belt 49 in a suitable manner.

One preferred embodiment of the simulating circuit 130 is shown in FIG. 3 and includes a shift register 132 associated with the second measuring path and a shift register 133 associated with the third measuring path. The clock pulse inputs of both shift registers are connected to the output of the pulse generator 93. The signal from light barrier 73 may be fed selectively, by setting of selector switches 134 and 135, respectively to any one of the first through sixth stages of register 132 and to any one of the first through 10th stages of register 133. In this way it is possible to vary the electrical length of the shift registers by adjusting the switching position of the respective selector switch and thus to adapt the given distance values A and B to prevailing conditions without having to change the position of the light barrier 71, and this separately for every measuring path.

A first signal corresponding to the second measuring path is derived via seven parallel outputs 132.1 to 132.7 from the last seven stages of shift register 132; and a second signal corresponding to the third measuring path is derived in the corresponding manner via seven outputs 133.1 to 133.7 of shift register 133, which, however, each have a respective inverter 136 connected between the associated stage and measuring path output.

Considering FIGS. 2 and 3 in conjunction with FIG. 4 which illustrates one preferred embodiment of logic circuit 120, it can easily be seen that the outputs 132.1 to 132.7 and 133.1 to 133.7 of the second and third measuring paths correspond, with respect to the signals they emit, and in particular the signal sequence, to the outputs of light barriers 71.1 to 71.7 of the first measuring path 71. Based on the position of the leading edge of object 1" being withdrawn from the stack, as shown in FIG. 2, the three light barriers 71.1, 71.2 and 71.3 of FIG. 4 are obturated so that each of their outputs has a logic "0", and the output of each of light barriers 71.4 to 71.7 has a logic "1".

Before an object reaches light barrier 73, that barrier emits a logic "1" which is supplied to the connected inputs of both shift registers 132 and 133. During the passage of an object through light barrier 73 the latter initially emits a continuous logic "0" to the selected inputs of shift register 132 and 133, so that a "0" appears at each of its outputs 132.1 to 132.7. As soon as the light barrier 73 has been cleared by the trailing edge of the object, it again emits, starting at that moment, a logic "1" to the inputs of shift registers 132 and 133, which "1" travels to the right through the register stages at a rate corresponding to the frequency of the clock pulses and thus to the object conveying speed, so that the individual signals from outputs 132.1 to 132.7 move from "0" to "1" in succession and in synchronism with passage of the trailing edge of the object along the second measuring path. In the same manner, due to the action of inverters 136, the signals from outputs 133.1 to 133.7 of shift register 133 move in succession from "0" to "1" in synchronism with passage of the leading edge of the object by the corresponding locations of the third measuring path defined by light barrier 73 and shift register 133.

The linkage circuit 120 which is part of the monitoring device forms a first output signal by logical linkage of the signals from the light barriers 71.1 to 71.7 belonging to the first measuring path and the signals from outputs 132.1 to 132.7 of the second measuring path, which is constituted by light barrier 73 and shift register 132. This is accomplished by the seven AND circuits 61.1 . . . 61.3 . . . 61.6 and 61.7, an inverter 62 and an OR circuit 63, shown in FIG. 4. The two inputs of the AND circuits 61.1 to 61.6 are connected in succession with light barriers 71.2 to 71.7 and the outputs 132.1 to 132.6 of shift register 132, as shown; the inputs of the last AND circuit 61.7 are connected to light barrier 71.7 via inverter 62 and directly with the output 132.7. The outputs of the AND circuits 61 are combined by the OR circuit 63.

The linkage circuit 120 additionally forms a second output signal by logical linkage of the signals from light barriers 71.1 to 71.7 and the signals from outputs 133.1 to 133.7 of the third measuring path, which is constituted by light barrier 73 and shift register 133. For this purpose the linkage circuit 120 includes seven more AND circuits 121.1 . . . 121.3 . . . 121.7, an inverter 122 and an OR circuit 123. The above-mentioned outputs and circuits are connected together in a suitable manner as shown in FIG. 4.

The control circuit 140 of the separator of FIG. 2 includes, as shown in FIG. 4, an AND circuit 142 whose inputs are connected with the outputs of OR circuits 63 and 123, respectively, as well as an AND circuit 64 whose first input is connected with the output of the light barrier 73 and whose second input is connected with the output of a selector switch 143. This makes it possible to connect the above-mentioned second input of AND circuit 64 selectively either to the output of the AND circuit 142 or, in circumvention thereof, directly to the output of the OR circuit 63, producing the first output signal, or the OR circuit 123, producing the second output signal. The mode of operation according to the invention for the apparatus is effected when the switch 143 is in the illustrated center position.

The control circuit 140 further includes an OR circuit 65 which emits a "1" if a "1" is present at the output of AND circuit 64 or at light barrier 71.1. This "1" travels via an AND circuit 66 to the brake coupling 30 as long as the second input of the AND circuit 66 is enabled by an externally generated "operation" signal provided through terminal 67; the withdrawal belt 25 is then driven via roller 21. Normally an operation signal is provided at terminal 67 whenever the system is in its normal operating mode.

To explain the mode of operation of the apparatus shown in FIGS. 2 to 4, the situation illustrated in FIG. 2 is again assumed to be the starting point, when a short object 1' is being carried to the right by conveyor belts 48 and 49 and the next succeeding object 1'' is still in the effective range of the withdrawal belt 25 and extends into the first measuring path 71, a distance d from the beginning of that path to the extent that it obstructs the three first light barriers 71.1, 71.2 and 71.3. Corresponding with the passage of object 1' by light barrier 73, the latter will have emitted input signals to the shift registers 132 and 133 in such a manner that an electrical simulation of object 1' in the form of a string of logic "0" signals passes through shift registers 132 and 133 under control of the clock pulses from pulse generator 93.

At the instant when the trailing edge of the object on the conveying path has reached a point whose distance a from the beginning of the measuring path 71 satisfies the relationship $a-d=A$, a "1" appears at the outputs 132.1, 132.2 and 132.3 of shift register 132 while a "0" appears at the remaining outputs 132.4 to 132.7. This is accomplished by the appropriate setting of selector switch 134 based on the desired distance value A. At this moment, a "0" will be present at the downstream outputs of shift register 133 and may or may not be present at the first few outputs 133.1, etc., depending on the length of object 1'.

At that instant, as is apparent from a consideration of FIG. 4, AND circuit 61.3 receives a "1" at both inputs 71.4 and 132.3 so that the monitoring device emits a first output signal to the control circuit 140 via OR circuit 63.

The second output signal is emitted to the control circuit 140 via the OR circuit 123 as soon as the leading edge of object 1' on the conveying path has reached a point whose distance b from the beginning of the measuring path 71 satisfies the relationship $b-d=B$. The electrical equivalent, or model, of object 1' in shift register 133 then has moved to the point where the first three outputs 133.1, 133.2 and 133.3 each emit a "1", at which time AND circuit 121.3, for example, for the first time has a "1" at both inputs which "1" travels through the OR circuit 123 to the second input of the AND circuit 142 of the control circuit 140.

The control circuit 140 then emits a control signal via AND circuit 64 enabled by a "1" from barrier 73, OR circuit 65 and AND circuit 66 enabled by a signal at terminal 67, to the brake coupling 30 so that the withdrawal belt 25 advances the next object 1'' into the effective range of conveying rollers 43 and 44. As soon as the light barrier 73 is then obstructed by the leading edge of the object, its signal no longer appears at AND circuit 64 and the withdrawal belt 25 stops. However, the conveying rollers 43 and 44 continue to pull object 1'' away from the stack so that object 1'' follows object 1' with a distance B being maintained between their leading edges. It is not undesirable if a further object is carried along to the point that it protrudes into measuring path 71. This substantially reestablishes the starting phase shown in FIG. 4.

If during withdrawal of object 1'' no further object has been carried along from the stack, a control signal is produced via OR circuit 65, upon release of light barrier 71.1 by the trailing edge of object 1'' so as to actuate the appropriate removal process.

The apparatus shown in FIGS. 2 through 4 operates in a corresponding manner if a long object has been pushed onto conveying path 48/49. Only now the output signal from the linkage circuit 120 which appears last and which thus triggers the control signal for the withdrawal process is produced in the second measuring path. This happens when the trailing edge of the object has reached the distance $a=A+d$ with respect to the start of the measuring path 71. The next object is therefore removed from the stack with its leading edge spaced a distance A from the trailing edge of the object presently in the conveying path.

Thus again, as in the embodiment of FIG. 1, there is an automatic selection of the reference edge of the preceding object which is to be decisive for the withdrawal process.

In the embodiment of FIGS. 2 to 4, the electrical equivalent, or simulation, of the second and third measuring paths is realized by a special circuit arrangement, i.e. the shift registers 132 and 133. Within the scope of the present invention it would also be possible, however, for the memory arrangement forming the equivalents to be part of a universal, or general purpose, data processing system, such as, for example, a process computer. Means would advisably be provided to vary or determine the distance values A and B to be given by insertion of selectable constants so that, in this case as well, the position of the light barrier 73 need not be changed or no further displaceable light barrier would be required, respectively.

FIG. 5 illustrates a basic embodiment of a monitoring device composed of two groups of light barriers 232 and 233 forming the second and third measuring paths. Light barriers 232 are connected directly to the outputs 232.1 . . . 0.7 for the second measuring path. Light barriers 233 are connected via respective inverters 236 to the outputs 233.1 . . . 0.7 for the third measuring path. Outputs 232.1 . . . 0.7 and 233.1 . . . 0.7 would be connected to lines 132.1 . . . 0.7 and 133.1 . . . 0.7, respectively, of logic circuit 120 of FIG. 4.

It will be understood that the above description of the present invention is susceptible to various modifications, changes and adaptations, and the same are intended to be comprehended within the meaning and range of equivalents of the appended claims.

What is claimed is:

1. In a procedure for discharging items whose lengths vary over a given range in succession from a stack and conveying the items, after discharge, along a conveying path with each item being oriented such that its length is parallel to the direction of conveyance and with each item on the conveying path being spaced from the next succeeding item subsequently discharged from the stack, the improvement comprising automatically controlling the discharge of each item in dependence on the length of the respective immediately preceding item on the conveying path in a manner such that for an immediately preceding item having a length exceeding a predetermined length value, the next succeeding item is introduced into the conveying path with its leading edge a first predetermined distance behind the trailing edge of such immediately preceding item, and for an immediately preceding item having a length less than the predetermined length value, the next succeeding item is introduced into the conveying path with its leading edge a second predetermined distance behind the leading edge of such immediately preceding item.

2. In a system for discharging items whose lengths vary over a given range in succession from a stack and conveying the items, after discharge, along a conveying path with each item being oriented such that its length is parallel to the direction of conveyance and with each item on the conveying path being spaced from the next succeeding item subsequently discharged from the stack, which system includes a pair of continuously driven conveying rollers which are arranged downstream of the stack and form the entrance of the conveying path, a controllable withdrawal device disposed between the conveying path and the stack and arranged to discharge each item in succession from the stack and operative in response to a control signal to advance each such item into the effective range of the conveying rollers, a monitoring device arranged to emit signals in dependence on the passage of the leading or trailing edge of an item past a point along the conveying path, and a control circuit arranged to produce the control signal for the withdrawal device in dependence on the signals from the monitoring device when the distance of the leading or trailing edge of the respective item from the leading edge of the next succeeding item present in the effective range of the withdrawal device has exceeded a given value, the improvement wherein:

said monitoring device comprises means for emitting a first output signal when the distance of the trailing edge of the item on said conveying path from the leading edge of the next succeeding item present in the effective range of said withdrawal device has exceeded a first predetermined distance, and means for emitting a second output signal when the distance of the leading edge of the item on said conveying path from the leading edge of the next succeeding item present in the effective range of said withdrawal device has exceeded a second predetermined distance;

said means for emitting are arranged such that the difference between said first and second distances is greater than the length of an item whose length is in the lower portion of the given range of lengths and less than the length of an item whose length is in the upper portion of the given range of lengths; and said control circuit includes means for emitting a control signal to actuate said withdrawal device for advancing the next succeeding item as soon as both the first and second output signals are emitted by said monitoring device;

whereby the discharge of each item is automatically controlled in dependence on the length of the respective immediately preceding item on said conveying path in a manner such that for an immediately preceding item having a length exceeding a predetermined length value, the next succeeding item is introduced into said conveying path with its leading edge spaced the first predetermined distance behind the trailing edge of such immediately preceding item, and for an immediately preceding item having a length less than the predetermined length value, the next succeeding item is introduced into said conveying path with its leading edge spaced the second predetermined distance behind the leading edge of such immediately preceding item.

3. An arrangement as defined in claim 2 further comprising means defining a first light barrier located between the output of the stack and the effective range of said conveying rollers, said barrier being effective across the path of travel of items from the stack to said conveying path and defining a waiting position for each item ahead of said conveying rollers, and wherein said monitoring device is arranged such that the first and second predetermined distances are selected with reference to the waiting position, and said control circuit is arranged to additionally emit a control signal to actuate said withdrawal device whenever said first light barrier is unobstructed by an item.

4. An arrangement as defined in claim 3 wherein said means for emitting a first output signal in said monitoring device includes a second light barrier located to correspond with the first predetermined distance, and said means for emitting a second output signal in said monitoring device includes a third light barrier located to correspond with the second predetermined distance, each of said second and third barriers being effective across said conveying path.

5. An arrangement as defined in claim 2 wherein said means for emitting a first output signal in said monitoring device includes an associated light barrier located to correspond with the first predetermined distance, and said means for emitting a second output signal in said monitoring device includes an associated light barrier located to correspond with the second predetermined distance, each of said associated barriers being effective across said conveying path.

6. An arrangement as defined in claim 2 wherein:

(a) said system further comprises means defining a first measuring path disposed between the output of the stack and the effective range of said conveying rollers and associated with said withdrawal device, and producing a first measuring path signal representative of the distance, d, between the leading edge of the item being acted on by said withdrawal device and the beginning of said first measuring path;

(b) said monitoring device further comprises means defining a second measuring path coextensive with a portion of said conveying path and producing a second measuring path signal representative of the distance, a, between the trailing edge of an item along said second measuring path and the beginning of said first measuring path, and means defining a third measuring path coextensive with a portion of said conveying path and producing a third measuring path signal representative of the distance, b, between the leading edge of an item along said third measuring path and the beginning of said first measuring path;

(c) said means for emitting a first output signal and a second output signal are connected to said means defining said first, second and third output signals in a manner to cause said first output signal to be emitted when the difference a−d exceeds said first predetermined distance and to cause said second output signal to be emitted when the difference b−d exceeds said second predetermined distance; and (d) said control circuit is arranged to emit its said control signal whenever, and as long as, no item is in the range of said first measuring path, as well as whenever both said first and said second output signals are being emitted simultaneously by said monitoring device.

7. An arrangement as defined in claim 6 wherein each of said means defining a measuring path is constituted by a respective plurality of light barriers spaced along the path of travel of items from the stack and responsive to such items along the associated measuring path.

8. An arrangement as defined in claim 6 wherein said means defining a first measuring path is constituted by a plurality of light barriers spaced along, and responsive to items traversing, said first measuring path, and said means defining said second and third measuring paths are constituted by a sensing member for producing a signal upon passage of an item past a point on said conveying path upstream of the beginning of said second measuring path, and an electrical item travel simulator connected to said member and providing second and third measuring path signals dependent on the signals produced by said sensing member and the speed of travel of items along said conveying path.

9. An arrangement as defined in claim 8 wherein said simulator comprises: a pulse generator connected to be driven in unison with the speed of travel of items along said conveying path for emitting a train of pulses at a frequency proportional to such speed; and memory means connected to receive the signals produced by said sensing member and the pulses emitted by said pulse generator for providing second and third measuring path signals constituting simulations of the movement of the trailing edge of an item along the second measuring path and the movement of the leading edge of the same item along the third measuring path, respectively.

10. An arrangement as defined in claim 9 wherein said memory means comprise: a first shift register which is associated with said second measuring path; a second shift register which is associated with said third measuring path, each said register having a clock pulse input connected to receive the pulses emitted by said pulse generator; and selector switch means connected to said sensing member and selectively connectable to any one of a plurality of stages of each said shift register for delivering the signals produced by said sensing member to a selected stage of each said shift register, thereby permitting the effective values of each of said first and second predetermined distances to be varied individually over a selected range.

* * * * *